US011731454B2

(12) United States Patent
Hong

(10) Patent No.: US 11,731,454 B2
(45) Date of Patent: Aug. 22, 2023

(54) FRAME FOR FIXING CANVAS

(71) Applicant: Soon Yong Hong, Seoul (KR)

(72) Inventor: Soon Yong Hong, Seoul (KR)

( * ) Notice: Subject to any disclaimer, the term of this patent is extended or adjusted under 35 U.S.C. 154(b) by 366 days.

(21) Appl. No.: 17/210,846

(22) Filed: Mar. 24, 2021

(65) Prior Publication Data

US 2021/0300108 A1 Sep. 30, 2021

(30) Foreign Application Priority Data

Mar. 31, 2020 (KR) ..... 10-2020-0039449

(51) Int. Cl.
*B44D 3/18* (2006.01)

(52) U.S. Cl.
CPC ..... *B44D 3/185* (2013.01)

(58) Field of Classification Search
CPC . B44D 3/18; B44D 3/185; D05C 1/00; D05C 1/02; D05C 1/04; D05B 39/00; D05B 39/005
See application file for complete search history.

(56) References Cited

U.S. PATENT DOCUMENTS 2,343,037 A * 2/1944 Adelman ..... E06B 9/52 160/381
3,936,968 A * 2/1976 Gilbert ..... A47G 1/10 248/490
4,993,866 A * 2/1991 Sugihara ..... A47G 1/101 403/402
5,502,906 A * 4/1996 Yamawaki ..... D06C 3/08 160/381
7,497,159 B2 * 3/2009 Kasuya ..... B41F 15/36 101/127.1
2017/0151772 A1 * 6/2017 Spiro ..... D06C 3/08

FOREIGN PATENT DOCUMENTS

FR 2912768 A1 * 8/2008 ..... E04B 1/30
KR 10-1226698 B1 1/2013
WO WO-2007123394 A1 * 11/2007 ..... B44D 3/185

* cited by examiner

*Primary Examiner* — Ismael Izaguirre
(74) *Attorney, Agent, or Firm* — NKL Law; Jae Youn Kim

(57) ABSTRACT

Provided is a canvas frame including a first frame which is made of a metal material and connected, formed in a rectangular frame shape, and provided so that a part of a front surface is in contact with a canvas, and has a body part in which the inside is hollowed and inner and outer fastening parts connected to inner and outer surfaces of the body part, respectively; and a second frame which is made of a foam synthetic resin and has an insertion groove formed on the upper portion so that the body part is inserted, a support part formed so that an edge of the canvas is fixed and supported to the lower portion thereof by a fixing member, and inner and outer insertion parts which are formed on inner and outer surfaces of the support part, respectively, to be inserted and fastened to the inner and outer fastening parts.

6 Claims, 8 Drawing Sheets

FRAME FOR FIXING CANVAS

CROSS-REFERENCE TO RELATED APPLICATION

This application claims under 35 U.S.C. § 119(a) the benefit of Korean Patent Application No. 10-2020-0039449 filed on Mar. 31, 2020, the entire contents of which are incorporated herein by reference.

BACKGROUND

(a) Technical Field

The present invention relates to a canvas frame, and more particularly, to a canvas frame that is used by tensioning and fixing the edge of a canvas used to draw a picture in an art studio, etc.

(b) Background Art

Generally, a canvas, a kind of special cloth, is used when drawing pictures such as Western painting, oil painting, etc. The canvas is a fabric used when a sail, a tent, a backpack, etc. are made or the oil painting is drawn in an art studio and the like, and the canvas is used by tensioning four sides of the canvas by using a tension device, being rolled on an approximately rectangular canvas frame, and being fixed and coupled to the canvas frame by a fixing member such as tacks, metal pins, fixing pins, staplers, etc., and then the picture is drawn on the canvas in this state.

The canvas frame is common to be formed into wood so that a fixing member such as tacks, metal pins, fixing pins, staplers, etc. may be embedded. However, when the canvas is fixed and used in the canvas frame made of wood, the canvas or the painting is mainly discolored by changes in external environment such as temperature, moisture, mold, etc., the wooden frame is easily twisted or corroded to deteriorate durability. As a result, the wood is chemically treated or a coating layer is formed on the surface of the wood, but there is a problem that the manufacturing and processing are inconvenient and not easy.

Meanwhile, recently, in order to improve the problems of the canvas frame made of wood described above, in Korean Patent Registration No. 10-1226698 (issued on Jan. 25, 2013), there is disclosed a frame for fixing a canvas which includes a first frame provided in a metallic rectangular frame and provided so that a front surface and an outer surface are partially in contact with a rear surface of a curved portion of a tensioned canvas; and a second frame made of wood and provided to be coupled to the rear surface of the first frame so that the edge of the canvas is fixed.

However, in Korean Patent Registration No. 10-1226698, since the second frame made of wood is coupled and used with the first frame made of metal, the problems of the wood frame described above still exist. Particularly, when the wood is contaminated, there are problems that its contaminant may be transferred to the canvas, it is difficult to be processed, and the durability is deteriorated.

In addition, since it is difficult to adjust the thickness of the canvas frame according to a canvas size without newly manufacturing the first frame and the first and second frames adhere to each other with an adhesive or coupled to each other with a screw, there is a problem that the coupling force is deteriorated to be easily separated or the manufacturing process is complicated and the manufacturing time and the manufacturing cost are rising.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

An object of the present invention is to provide a canvas frame in which a synthetic resin frame is coupled to a metal frame, so that the frame is light and strong, the manufacturing and processing are easy, discoloration and contamination of the canvas or a painting are prevented according to a change in external environment such as temperature, moisture, mold, etc., the frame is not corroded or easily twisted or deformed like wood to have excellent durability, the tensioned canvas is firmly fixed and supported on not only a rear surface but also a side surface, and the thickness of the frame is easily adjusted to have excellent scalability.

In order to solve the problems, there is provided a canvas frame including a first frame which is made of a metal material and connected, formed in a rectangular frame shape, and provided so that a part of a front surface is in contact with a canvas, and has a body part in which the inside is hollowed and inner and outer fastening parts connected to inner and outer surfaces of the body part, respectively; and a second frame which is made of a foam synthetic resin and has an insertion groove formed on the upper portion so that the body part is inserted, a support part formed so that an edge of the canvas is fixed and supported to the lower portion thereof by a fixing member, and inner and outer insertion parts which are formed on inner and outer surfaces of the support part, respectively, to be inserted and fastened to the inner and outer fastening parts.

According to the present invention, since a synthetic resin frame is coupled to a metal frame, there are effects that the frame is light and strong, the manufacturing and processing are easy, discoloration and contamination of the canvas or a painting are prevented according to a change in external environment such as temperature, moisture, mold, etc., the frame is not corroded or easily twisted or deformed like wood to have excellent durability, the tensioned canvas is firmly fixed and supported on not only a rear surface but also a surface, and the thickness of the frame is easily adjusted to have excellent scalability.

It should be understood that the effects of the present invention are not limited to the effects described above, but include all effects that can be deduced from the detailed description of the present invention or configurations of the invention described in appended claims.

DETAILED DESCRIPTION

Figure 1A:
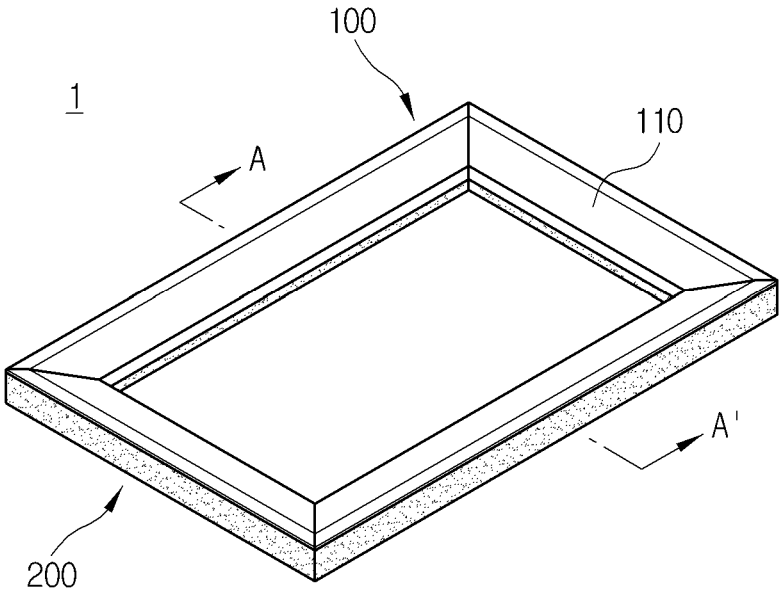
FIG. 1A is a front perspective view of a canvas frame according to the present invention.
Figure 1B:
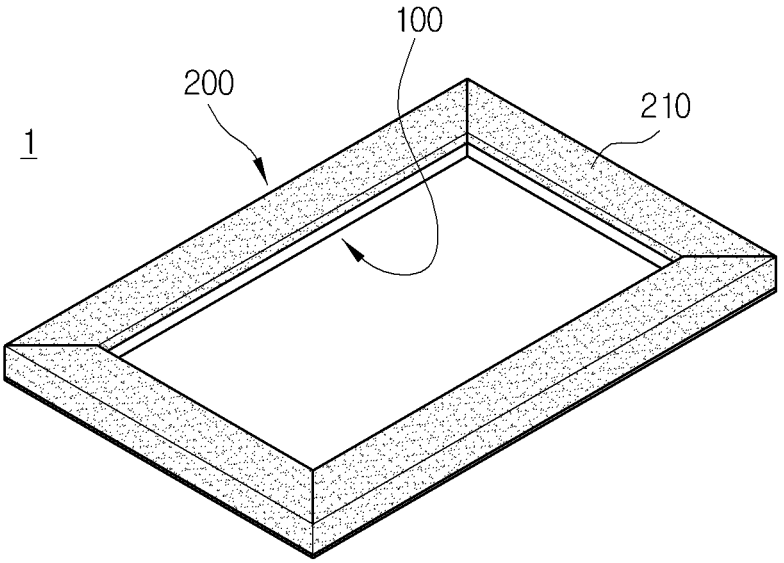
FIG. 1B is a rear perspective view.
Figure 1C:
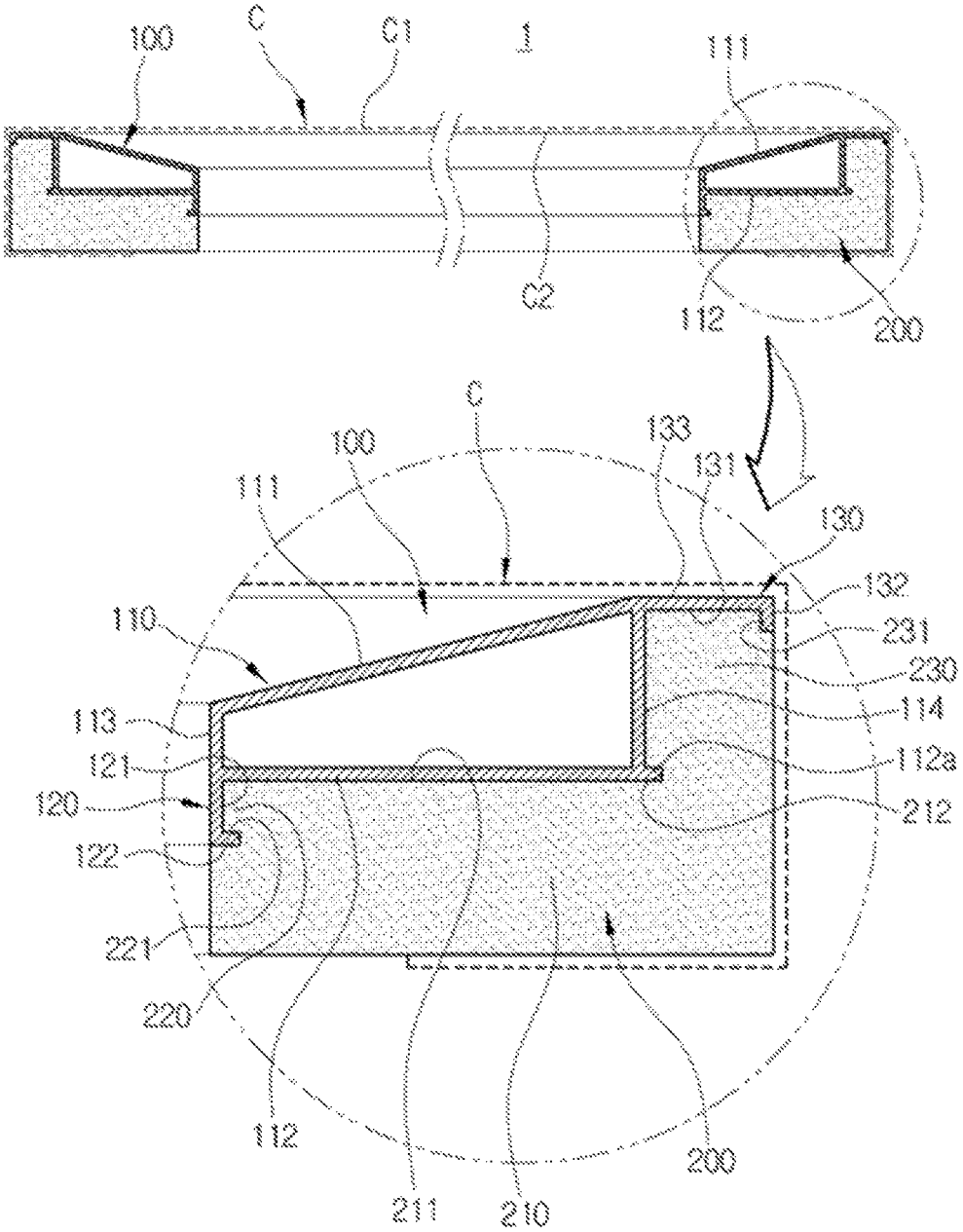
FIG. 1C is a diagram illustrating a state where a canvas is fixed, as a cross-sectional view of AA' of FIG. 1A.
Figure 2A:
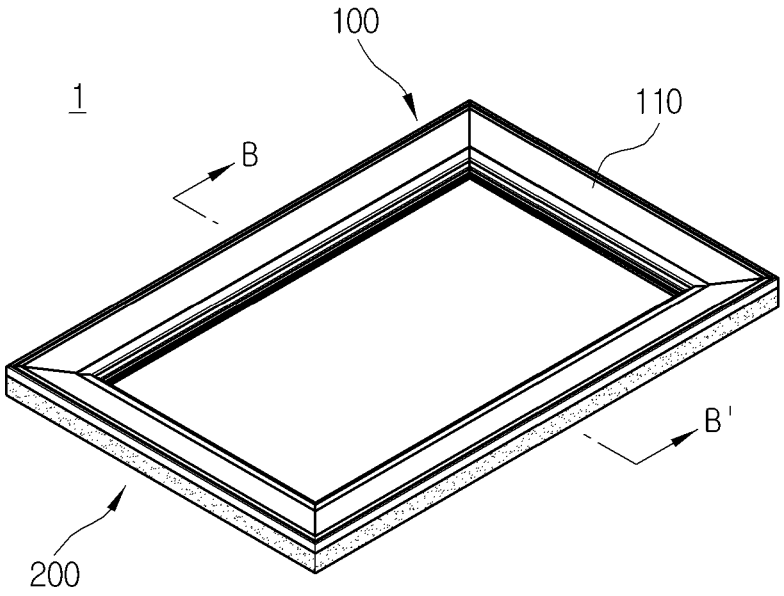
FIG. 2A is a front perspective view of a canvas frame according another embodiment to the present invention.
Figure 2B:
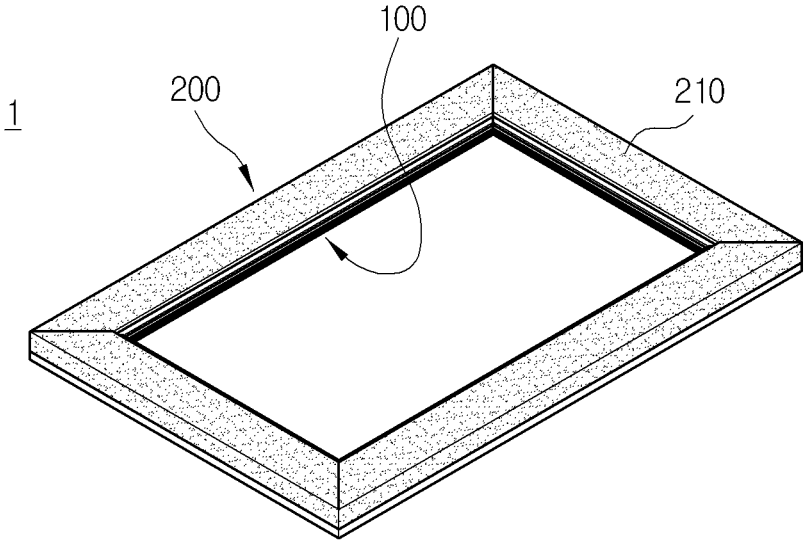
FIG. 2B is a rear perspective view.
Figure 2C:
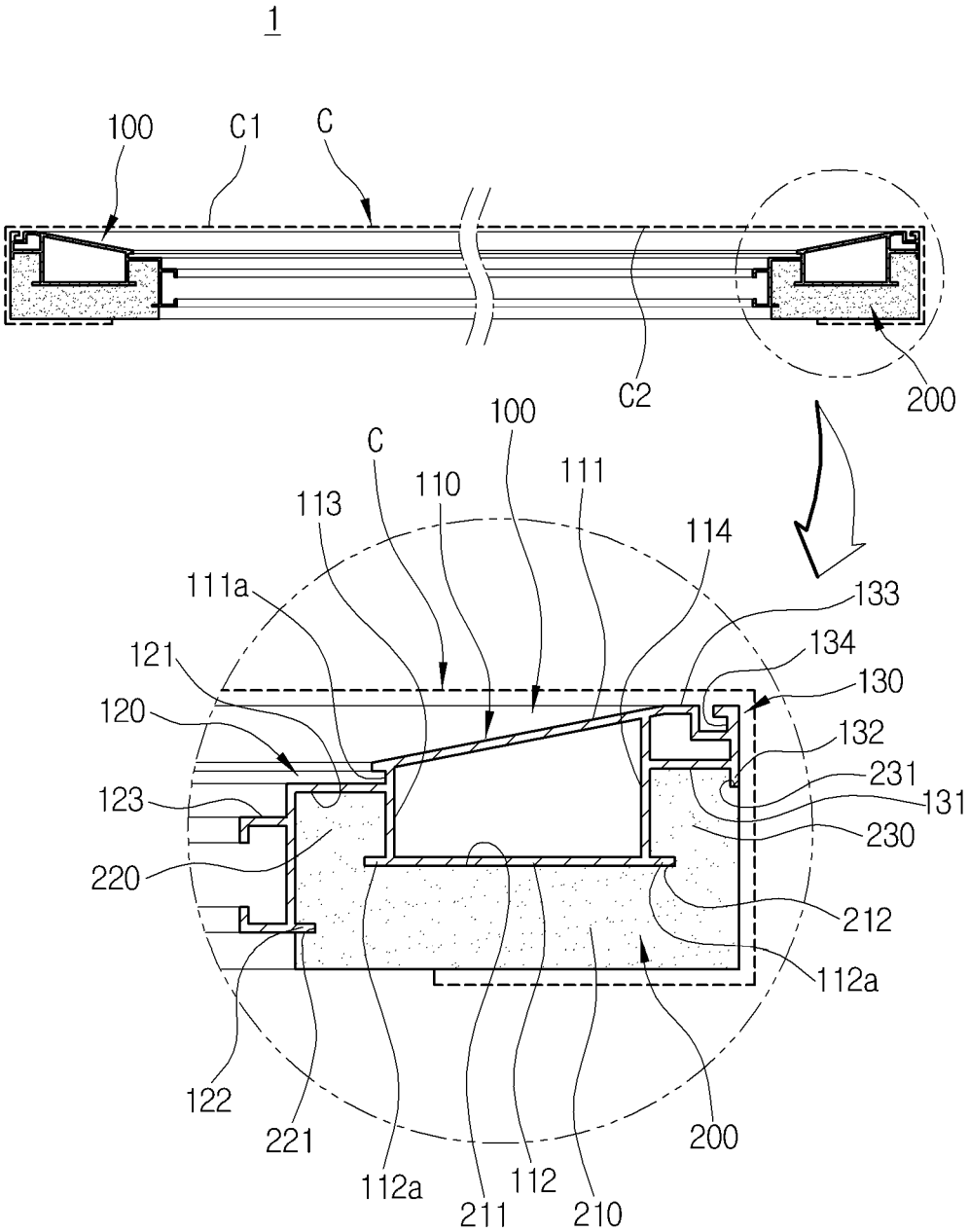
FIG. 2C is a diagram illustrating a state where a canvas is fixed, as a cross-sectional view of BB' of FIG. 2A.
Figure 3:
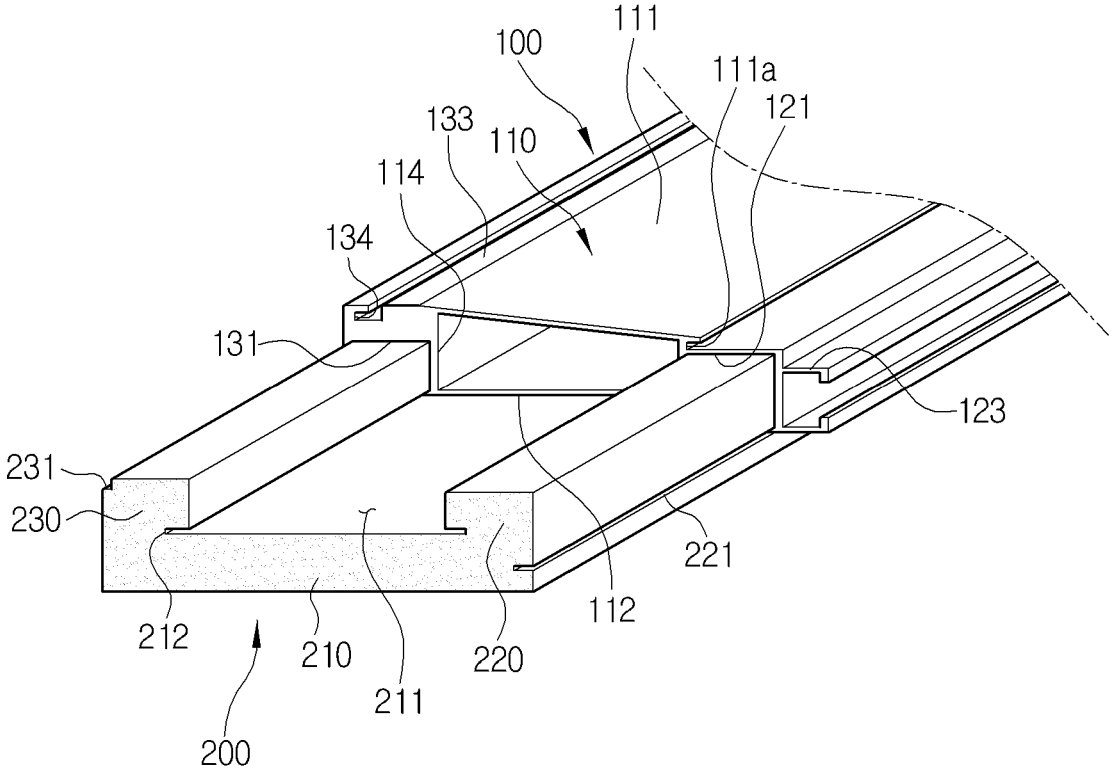
FIG. 3 is a partially perspective view of a canvas frame according to an embodiment of the present invention.

Hereinafter, detailed contents for implementing a canvas frame according to the present invention will be described in detail with reference to the accompanying drawings.

A canvas frame 1 according to the present invention is used to tightly pull and fix a canvas used to draw a picture in an art studio and the like, and referring to FIGS. 1A to 3, the canvas frame 1 is formed by coupling a first frame 100 made of metal and a second frame 200 made of a foam synthetic resin to each other.

The first frame 100 is formed of a light metal material such as aluminum, and a plurality of unit frames are connected to each other by a welding or coupling member to be formed in a rectangular frame shape, and a part of the front surface is provided to be in contact with a canvas C. For this end, the first frame 100 may be configured by including a body part 110 that is hollowed so that the inside is empty, an inner fastening part 120 connected to an inner surface 113 of the body part 110, and an outer fastening part 130 connected to an outer surface 114 of the body part 110.

The body part 110 has a shape in which four bars are coupled to each other, and includes a front surface 111 which has a hallow inside and is inclined downward toward the inside, inner and outer surfaces 113 and 114 connected to both sides of the front surface 111 in a vertical direction, respectively, and a rear surface 112 horizontally connecting lower ends of the inner and outer surfaces 113 and 114.

In addition, the inner fastening part 120 and the outer fastening part 130 have inner and outer fastening grooves 121 and 131 so that all or some of an inner insertion part 220 and an outer insertion part 230 of the second frame 200 are inserted and fastened, respectively, thereby enabling the first and second frames 100 and 200 to be firmly and easily fastened to each other.

In addition, the outer fastening part 130 is provided with a support surface 133 of which a front surface is flatly formed to support the canvas C which is tightly tensioned and fixed so as to prevent the canvas C from falling down, and the front surface 111 of the body part 110 is inclined to minimize an area in contact with the canvas and prevent a drawing operation from being hindered.

As such, since the first frame 100 is made of metal such as aluminum and the canvas C is in contact with metal, as compared with a conventional canvas frame in which wood has been included, its weight is light, an assembled state is tight, and the discoloration and contamination of the canvas or a picture drawn on the canvas are prevented depending on a change in external environment, such as temperature, moisture, mold, etc.

Since the second frame 200 is made of a foam synthetic resin, the second frame is excellent in molding and processability and excellent in insulation, waterproof, and warmth to be protected from temperature, moisture, mold, etc., so that a product value increases, has an impact absorbing property to be protected from external impacts, and may be recycled as a resource.

Further, the second frame 200 is coupled to the rear surface side of the first frame 100, may have various cross-sectional shapes such as "L", "⊔", and the like, and is coupled to the first frame by an insertion method other than an adhesive or screw fastening in the related art, so that a manufacturing process is simple, and as a result, the second frame may be easily manufactured and a firmly coupled state may be maintained.

To this end, in the second frame 200, an insertion groove 211 is formed on the support part 210 to be inserted and fastened with a part of the body part 110, an edge of the tensioned canvas C is fixed and supported to the lower portion of the support part 210 through a fixing member (not illustrated), an inner insertion part 220 is formed on the inner surface of the support part 210 to be inserted and fastened to the inner fastening part 120, and an outer insertion part 230 is formed on the outer surface of the support part 210 to be inserted and fastened to the outer fastening part 130, so that the first and second frames 100 and 200 may be firmly coupled to each other.

At this time, the outer insertion part 230 may be formed to expose most of the outer surface to the outside to further firmly fix and support the tensioned canvas C through the fixing member.

In addition, an inner connection groove 212 is formed inside the insertion groove 211 of the support part 210, and an inner connection piece 112*a* is formed to protrude from one end or both ends of the rear surface 112 of the body part 110 to be connected to the inner connection groove 212. In addition, an inner connection groove 221 and an outer connection groove 231 are formed on the inner surface of the inner insertion part 220 and the outer surface of the inner insertion part 230, respectively, to be connected to an inner connection piece 122 and an outer connection piece 132 formed on the inner fastening part 120 and the outer fastening part 130, respectively. As a result, the first and second frames 100 and 200 are connected to the inside and the outside so as to be firmly fastened each other and be prevented from being separated from each other or moving to have no gap, thereby increasing the durability.

In addition, the second frame 200 coupled to the first frame 100 is manufactured and prepared at various thicknesses, and when the second frame 200 having a suitable thickness is selected as need for a canvas size or the like to be fastened to the first frame 100, the thickness of the canvas frame 1 may be adjusted.

In the case of fixing the canvas C to the canvas frame 1 according to the present invention described above, while the canvas C is tensioned by a tension device (not illustrated), the canvas C is curved to the rear surface of the canvas frame 1 to be fixed to the second frame 200 using a fixing member such as tacks, metal pins, fixing pins, staplers, etc. Since the canvas fixation using this fixing member is a well-known or commonly used technique, the detailed description will be omitted.

That is, the canvas C is placed so that a surface Cl on which the picture is drawn faces the front surface and a back surface opposed thereto faces the rear surface. In this state, when the edge of the canvas C is tightly pulled and tensioned and curved twice in a rear surface direction, the edge of the canvas C is in contact with the rear surface of the second frame 200 through the outer fastening part 130 and the outer insertion part 230, and in this state, is fixed to the second frame 200 using a fixing member such as tacks, metal pins, fixing pins, staplers, etc. At this time, the fixing member is also fastened to the outer surface of the outer insertion part 230 to further firmly fix the canvas C.

As such, the canvas frame 1 according to the present invention is made of the metal and the foam synthetic resin to be light in weight and protected from temperature, moisture, mold, etc., and as a result, the canvas is not discolored or contaminated and not easily twisted or deformed to have excellent durability. Furthermore, the wood is bad in molding and processibility, but the present invention uses the foam synthetic resin to enable precise processing. Thus, thin grooves are easily formed to insert and fasten various connection pieces of the first frame 100 made of the metal material, thereby performing more firmly coupling.

Figure 4:
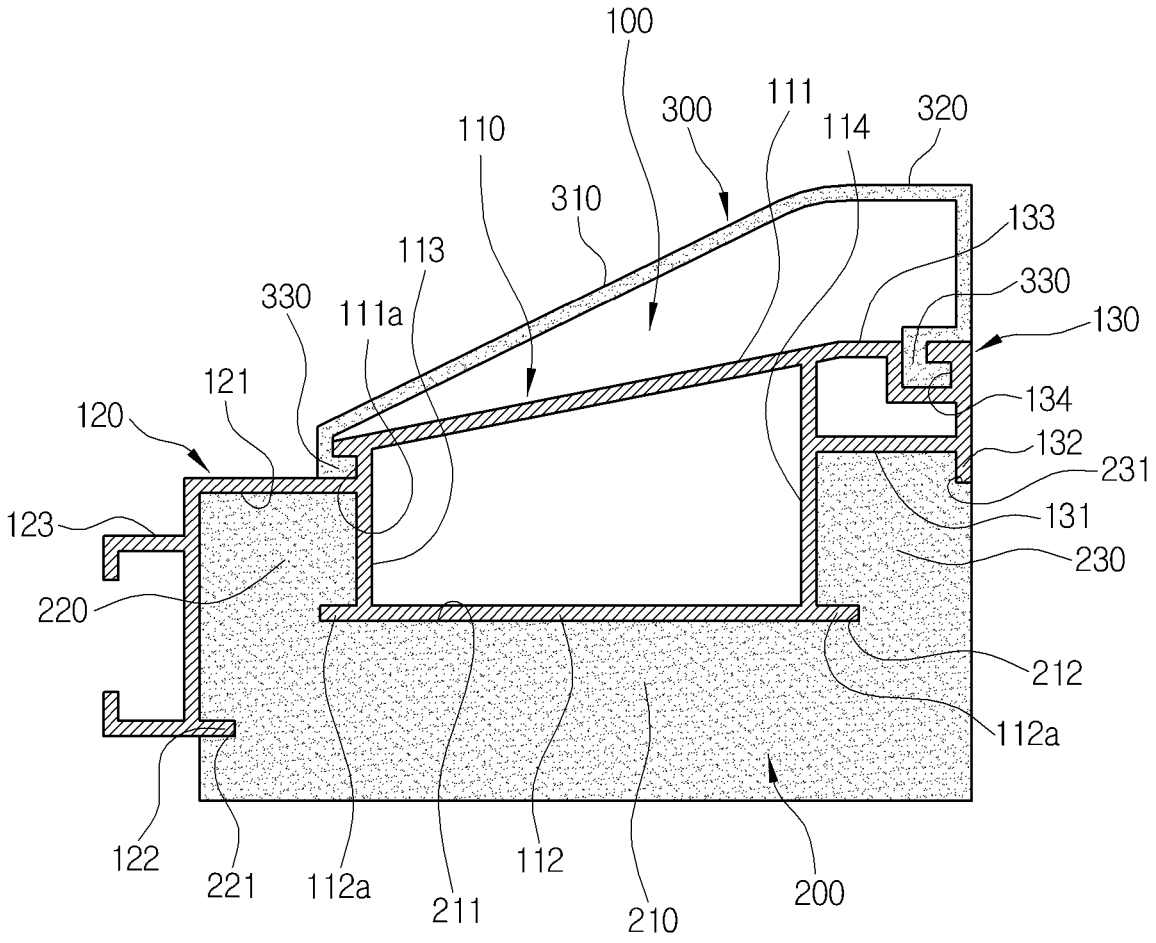
FIG. 4 is a cross-sectional view of a canvas frame including a third frame of the present invention.

Further, referring to FIG. 4, as another embodiment, a third frame 30 made of a metal material may be further fastened to the front surface side of the first frame 100 to be extended, and the third frame 300 has an inclined surface 310 formed on the front surface thereof to be inclined downward toward the inside, a flat support surface 320 formed at one side of the inclined surface thereof, and fastening pieces 330 formed at both sides thereof.

The third frame 300 may be prepared at a size having various thicknesses, and the third frame 300 having an appropriate size is selected as needed for a size of the canvas C or the like to be fastened to the first frame 100, thereby enabling the thickness adjustment of the canvas frame. At this time, the fastening pieces 330 formed at both sides of the third frame 300 are fastened to upper grooves 111*a* and 134 formed on the body part 110 and the outer fastening part 130 of the first frame 100, respectively, thereby increasing the scalability.

Figure 5A:
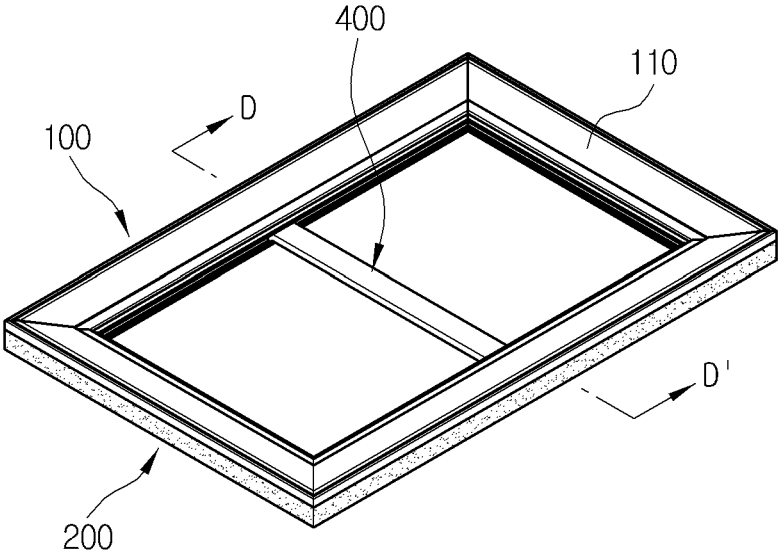
FIG. 5A is a front perspective view of a canvas frame including an inner frame of the present invention and FIG. 5B is a diagram illustrating a state where the canvas is fixed as a cross-sectional view of DD' of FIG. 5A.
Figure 5B:
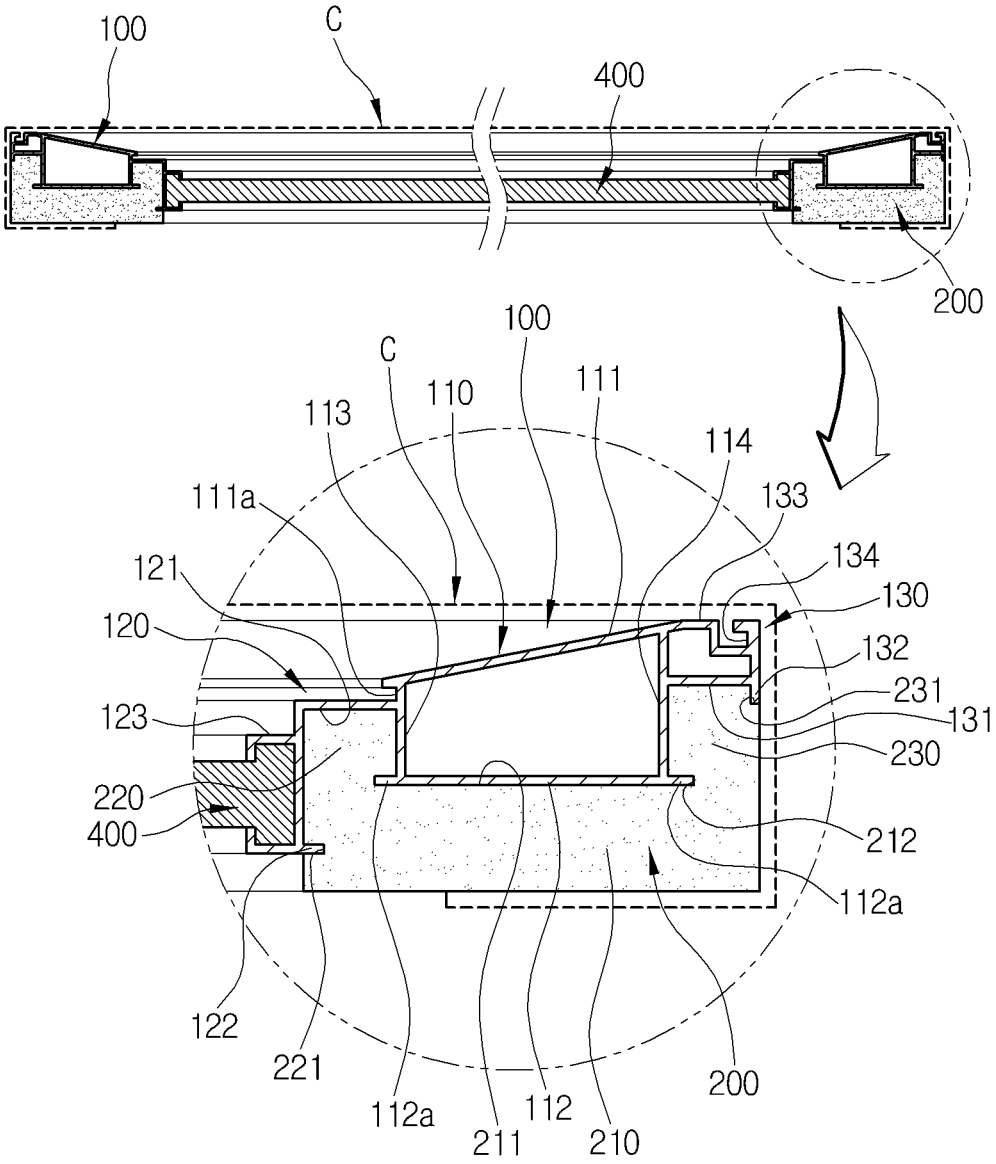

Further, referring to FIGS. 5A and 5B, the inner fastening part 120 has an insertion piece 123 formed on the inner surface thereof so that an inner frame 400 passing through a rectangular inner space of the canvas frame may be inserted and fastened to the insertion piece 123. Such an inner frame 400 may be formed in a "–" or "+" shape, thereby further strengthening the canvas frame and preventing the falling-down of the canvas when an artist draws a picture.

What is claimed is:

1. A canvas frame comprising:

a first frame which is made of a metal material and connected and formed in a rectangular frame shape, and provided so that a part of a front surface is in contact with a canvas, and has a body part in which the inside is hollowed and inner and outer fastening parts connected to inner and outer surfaces of the body part, respectively; and a second frame which is made of a foam synthetic resin and has an insertion groove formed on the upper portion so that the body part is inserted, a support part formed so that an edge of the canvas is fixed and supported to the lower portion thereof by a fixing member, and inner and outer insertion parts which are formed on inner and outer surfaces of the support part, respectively, to be inserted and fastened to the inner and outer fastening parts.

2. The canvas frame of claim 1, wherein the body part is configured by including a front surface which is inclined downward toward the inside, inner and outer surfaces connected to both sides of the front surface in a vertical direction, respectively, and a rear surface horizontally connecting lower ends of the inner and outer surfaces, and the inner and outer fastening parts have inner and outer fastening grooves so that inner and outer insertion parts of the second frame are inserted and fastened, respectively, and the outer fastening part has a front surface flatly formed.

3. The canvas frame of claim 1, wherein an inner connection groove is formed inside the insertion groove of the support part, and an inner connection piece is formed at one end or both ends of the rear surface of the body part to be connected to the inner connection groove, and an inner connection groove and an outer connection groove are formed on the inner surface of the inner insertion part and the outer surface of the outer insertion part, respectively, to be connected to an inner connection piece and an outer connection piece formed on the inner fastening part and the outer fastening part, respectively.

4. The canvas frame of claim 1, wherein the outer insertion part is formed to expose the outer surface to fix and support the tensioned canvas through a fixing member.

5. The canvas frame of claim 1, further comprising:

a third frame which is made of a metal material and provided at various sizes to be fastened to the front surface of the first frame, so as to enable the thickness adjustment of the canvas frame, wherein fastening pieces formed at both sides of the third frame are coupled with upper grooves formed on the body part and the outer fastening part of the first frame, respectively.

6. The canvas frame of claim 1, wherein the inner fastening part has an insertion piece formed on the inner surface so that an inner frame passing through an inner space of the canvas frame is inserted and fastened to the insertion piece.

* * * * *